US009174463B2

(12) United States Patent
Shinagawa et al.

(10) Patent No.: US 9,174,463 B2
(45) Date of Patent: Nov. 3, 2015

(54) CONTROL METHOD OF A SERIAL PRINTER, AND SERIAL PRINTER

(71) Applicant: Seiko Epson Corporation, Tokyo (JP)

(72) Inventors: Hiroki Shinagawa, Matsumoto (JP); Hiroyasu Fukazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/521,772

(22) Filed: Oct. 23, 2014

(65) Prior Publication Data

US 2015/0130870 A1 May 14, 2015

(30) Foreign Application Priority Data

Nov. 13, 2013 (JP) ..... 2013-234713

(51) Int. Cl.
*B41J 11/00* (2006.01)
*B41J 25/308* (2006.01)
*B41J 2/165* (2006.01)

(52) U.S. Cl.
CPC ..... *B41J 11/006* (2013.01); *B41J 25/3088* (2013.01); *B41J 2/1652* (2013.01); *B41J 2/16511* (2013.01)

(58) Field of Classification Search
CPC ..... B41J 11/006
USPC ..... 347/16
See application file for complete search history.

(56) References Cited

U.S. PATENT DOCUMENTS

| | | | | |
|---|---|---|---|---|
| 2006/0181556 | A1 | 8/2006 | Wanibuchi et al. | |
| 2010/0156984 | A1* | 6/2010 | Chikamoto | 347/16 |
| 2013/0076822 | A1* | 3/2013 | Ogimura | 347/14 |

FOREIGN PATENT DOCUMENTS

| | | |
|---|---|---|
| JP | 2006-225161 | 8/2006 |
| JP | 2008-080649 | 4/2008 |
| JP | 2011-148127 | 8/2011 |
| JP | 2012-086509 | 5/2012 |
| JP | 2012-240813 | 12/2012 |

* cited by examiner

*Primary Examiner* — Jason Uhlenhake

(57) ABSTRACT

A control method of a serial printer enables easily removing the printing paper when a paper jam occurs, and can prevent or suppress damage to the printhead when removing the printing paper. A serial printer 1 conveys printing paper P by a conveyance mechanism 22 including a second paper feed roller pair 31 located upstream from the print position A in the first conveyance direction M1. If a paper jam of the printing paper P is detected when the printhead 12 is at a position opposite the horizontal conveyance path portion 13*c* of the paper conveyance path 13, conveyance of the printing paper P first stops, and the printhead 12 is then moved on the vertical axis Z away from the horizontal conveyance path portion 13*c*. Next, the printhead 12 is moved on the transverse axis X to a away position 12AW outside the horizontal conveyance path portion 13*c*, and nipping of the printing paper P by the second paper feed roller pair 31 is then released.

8 Claims, 8 Drawing Sheets

CONTROL METHOD OF A SERIAL PRINTER, AND SERIAL PRINTER

BACKGROUND

1. Technical Field

The present invention relates to a serial printer and a control method of a serial printer that retracts the printhead when the recording paper jams.

This application is based upon Japan Patent Appl. Pub. No. 2013-234713 filed on Nov. 13, 2013.

2. Related Art

A printer that conveys recording paper through a paper conveyance path past the print position of the printhead and prints on the recording paper at the print position is described in JP-A-2012-86509. The printer disclosed in JP-A-2012-86509 conveys the recording paper by a pair of conveyance rollers. The paper conveyance roller pair includes a conveyance roller to which the drive power of a conveyance motor is conveyed, and a follower roller that follows rotation of the conveyance roller. The printhead can move between the print position and a retracted position separated from the print position. A linkage mechanism that moves the follower roller in conjunction with movement of the printhead is disposed between the printhead and the follower roller.

In the printer described in JP-A-2012-86509, the follower roller is pressed against the conveyance roller when the printhead is set to the print position, and can nip and convey the recording paper. When the printhead is set to the retracted position, the follower roller separates from the conveyance roller. Therefore, when the recording paper conveyed through the conveyance path jams (a paper jam occurs), nipping of the recording paper by the conveyance roller pair is released by moving the printhead from the print position to the retracted position. As a result, the recording paper that is stuck can be removed from the paper conveyance path.

When the printer is a serial printer that moves the printhead bidirectionally at the print position in the transverse direction perpendicularly to the conveyance direction of the recording paper, it may be necessary to move the printhead in the transverse direction from the position opposite the paper conveyance path to a retracted position outside of the paper conveyance path when the recording paper jams during the printing process. Nipping of the recording paper by the conveyance roller pair that conveys the recording paper on the upstream side of the print position may also be released parallel to moving the printhead.

However, when nipping of the recording paper by the conveyance roller pair is released parallel to moving the printhead in the transverse direction, the recording paper can easily lift away from the print position toward the printhead as a result of the conveyance roller pair releasing the recording paper, and the recording paper can easily contact the printhead. When the recording paper and the printhead contact, the recording paper can damage the printhead when the printhead moves to the retracted position. Furthermore, if the printhead is in contact with the recording paper when the recording paper jams, and the conveyance roller pair is released from the nipping position parallel to the printhead moving in the transverse direction, the printhead will also move the recording paper transversely to the paper conveyance path when the printhead moves to the retracted position. When this happens, removing the recording paper from the paper conveyance path by moving the recording paper can be difficult.

SUMMARY

A serial printer and a control method of a serial printer according to the present invention enable easily removing recording paper that has jammed, and can prevent or suppress damage to the printhead when removing the recording paper.

One aspect of the invention is a control method of a serial printer that conveys recording paper through a paper conveyance path past the print position of a printhead, and prints by moving the printhead at the print position transversely to the paper conveyance path and perpendicularly to the conveyance direction of the recording paper, the control method including: conveying the recording paper through the paper conveyance path by a conveyance mechanism including a paper feed roller pair disposed on the upstream side of the print position in the conveyance direction; and when a paper jam of the recording paper is detected when the printhead is positioned opposite the paper conveyance path, stopping conveyance of the recording paper, moving the printhead away from the paper conveyance path in the direction of opposition between the printhead and the paper conveyance path, then moving the printhead in the transverse direction to a retracted position removed to the outside of the paper conveyance path, and then releasing nipping of the recording paper by the paper feed roller pair.

When the paper jam occurs with the printhead positioned opposite the paper conveyance path in this configuration, conveyance of the recording paper by the paper feed roller pair stops first, the printhead then moves in the direction of opposition in the direction away from the paper conveyance path and away from the recording paper that is jammed, and the printhead then moves in the transverse direction. The paper feed roller pair keeps the recording paper nipped, and prevents the recording paper from rising away from the paper conveyance path toward the printhead, until the printhead moves in the transverse direction and reaches the retracted position.

As a result, when the printhead is set to the retracted position separated from the paper conveyance path, contact between the recording paper and the printhead can be prevented or suppressed.

In addition, because the paper feed roller pair continues to hold the recording paper when the printhead moves in the transverse direction, the printhead can be prevented or suppressed from moving the recording paper on the paper conveyance path in the transverse direction when the printhead moves to the retracted position. Removing the recording paper from the paper conveyance path being difficult when nipping by the paper feed roller pair is then released can therefore be prevented or suppressed.

A control method of a serial printer according to another aspect of the invention further preferably includes: when a paper jam of the recording paper is detected when the printhead is at the retracted position, stopping conveyance of the recording paper, moving the printhead away from the paper conveyance path in the direction of opposition, and then releasing nipping of the recording paper by the paper feed roller pair.

Thus comprised, contact between the recording paper and the printhead can be prevented or suppressed when nipping by the paper feed roller pair is released because the printhead is removed from the paper conveyance path.

Further preferably, when a paper jam of the recording paper is detected when the printhead is at a position opposite the paper conveyance path, moving the printhead in the opposite direction as the direction the printhead was moving when the paper jam of the recording paper was detected, and setting the printhead to a retracted position at one side or the other side of the paper conveyance path width.

Thus comprised, the recording paper that jammed at the print position can be prevented from being further compressed and made difficult to remove by movement of the printhead.

Further preferably control method of a serial printer according to another aspect of the invention also includes: monitoring the load of the head moving motor that is the drive source of the moving mechanism that moves the printhead in the transverse direction; and detecting a paper jam of the recording paper when the printhead is at a position opposite the paper conveyance path based on change in the load of the head moving motor.

More specifically, if the recording paper jams when the printhead is at a position opposite the paper conveyance path, the printhead is printing, and movement of the printhead that moves in the transverse direction or the carriage that carries the printhead will interfere with the recording paper. Because interference with the recording paper can prevent moving the printhead in this event, the load on the head moving motor, which is the drive source for moving the printhead, increases. A paper jam can therefore be detected based on change in the load of the head moving motor.

In a control method of a serial printer according to another aspect of the invention, a paper detector that detects the presence of the recording paper is disposed on the upstream side of the paper feed roller pair in the conveyance direction; and the control method further includes monitoring the drive amount and the load of the conveyance motor that is the drive source of the conveyance mechanism; and detecting a paper jam of the recording paper when the printhead is at the retracted position based on the output of the paper detector and change in the drive amount and load of the conveyance motor.

More specifically, if the recording paper jams when the printhead is at the retracted position, the paper detector will not detect the recording paper even if the amount the conveyance motor is driven exceeds the amount necessary to convey the recording paper to the detection position of the paper detector. The paper jam can therefore be detected based on how much the conveyance motor is driven and the output of the paper detector. Furthermore, because the recording paper cannot be conveyed in the conveyance direction if the recording paper jams when the printhead is at the retracted position, the load on the conveyance motor increases. The paper jam can therefore be detected based on the change in the load of the conveyance motor. The drive amount the conveyance motor may be the drive time of the conveyance motor or the angle of rotation. If the conveyance motor is a stepper motor, the number of steps the motor is driven, for example, may be used as the drive amount.

Another aspect of the invention is a serial printer, including: a printhead; a carriage that carries the printhead; a paper conveyance path that carries the recording paper past the print position of the printhead; a conveyance mechanism that has a paper feed roller pair disposed upstream in the conveyance direction from the print position, and conveys the recording paper through the paper conveyance path; a first moving mechanism that moves the carriage transversely to the paper conveyance path and perpendicularly to the conveyance direction; a second moving mechanism that moves the carriage in the direction away from the paper conveyance path in the direction of opposition between the printhead and the paper conveyance path; a roller moving mechanism that moves at least one of the paper feed roller and the follower roller of the paper feed roller pair from a nipping position where the paper feed roller pair can nip the recording paper to a release position where there is a gap to the other roller; a conveyance motor that is the drive source of the conveyance mechanism; a head moving motor that is the drive source of the first moving mechanism; a conveyance control unit that drives the conveyance motor and conveys the recording paper; a first paper jam detector that monitors the load of the head moving motor, and based on change in the load of the head moving motor, detects a paper jam of the recording paper when the printhead is at a position opposite the paper conveyance path; and a first control unit that, when a paper jam of the recording paper is detected by the first paper jam detector, stops the conveyance motor, drives the second moving mechanism and moves the printhead in the direction away from the paper conveyance path in the direction of opposition between the printhead and the paper conveyance path, then drives the head moving motor, moves the printhead in the transverse direction to a retracted position separated to the outside from the paper conveyance path, and then drives the roller moving mechanism and moves at least one of the conveyance roller and the follower roller to the release position.

When the printhead is positioned opposite the paper conveyance path and a paper jam occurs in this aspect of the invention, the conveyance motor first stops and conveyance of the recording paper by the paper feed roller stops. Next, the printhead is moved in the direction of opposition away from the paper conveyance path by the second moving mechanism, and is thereby separated from the jammed recording paper. Next, the head moving motor is driven, and the printhead is moved in the transverse direction to the retracted position. The paper feed roller pair continues to hold (nip) the recording paper until the printhead reaches the retracted position, thereby preventing the recording paper from separating from the paper conveyance path toward the printhead. Therefore, when the printhead is set to the retracted position separated from the paper conveyance path, contact between the recording paper and the printhead can be prevented or suppressed.

Furthermore, because the paper feed roller pair keeps the recording paper nipped when the printhead moves in the transverse direction, the printhead can be prevented from moving the recording paper on the paper conveyance path in the transverse direction in conjunction with the printhead moving to the retracted position. Therefore, removing the recording paper from the paper conveyance path being difficult when the recording paper is then released by the paper feed roller pair can be prevented or suppressed.

In addition, if the recording paper jams when the printhead is at a position opposite the paper conveyance path, the printhead is printing, and movement of the printhead that moves in the transverse direction or the carriage that carries the printhead will interfere with the recording paper. Because interference with the recording paper can prevent moving the printhead in this event, the load on the head moving motor, which is the drive source for moving the printhead, increases. A paper jam can therefore be detected based on change in the load of the head moving motor.

A serial printer according to another aspect of the invention preferably also has a paper detector that detects the presence of the recording paper on the upstream side of the paper feed roller pair in the conveyance direction; a second paper jam detector that monitors the drive amount and the load of the conveyance motor, and detects a paper jam of the recording paper when the printhead is at the retracted position based on the output of the paper detector and change in the drive amount of the conveyance motor and the load of the conveyance motor; and a second control unit that, when a paper jam is detected by the second paper jam detector, stops the conveyance motor, drives the second moving mechanism and moves the printhead in the direction of opposition away from the paper conveyance path, and then drives the roller moving mechanism and moves at least one of the paper feed roller and the follower roller to the release position.

Thus comprised, because the printhead separates from the paper conveyance path, contact between the recording paper and the printhead can be prevented or suppressed when removing the recording paper from the paper conveyance path. Furthermore, if the recording paper jams when the printhead is at the retracted position, the recording paper will not be conveyed by the conveyance mechanism to the detection position of the paper detector even if the conveyance motor is driven at least a specific amount.

The paper jam can therefore be detected based on how much the conveyance motor is driven and the output of the paper detector. Furthermore, because the recording paper cannot be conveyed in the conveyance direction if the recording paper jams when the printhead is at the retracted position, the load on the conveyance motor increases. The paper jam can therefore be detected based on the change in the load of the conveyance motor. The drive amount the conveyance motor may be the drive time of the conveyance motor or the angle of rotation. If the conveyance motor is a stepper motor, the number of steps the motor is driven, for example, may be used as the drive amount.

In a serial printer according to another aspect of the invention, the first control unit determines if the direction of carriage movement by the first moving mechanism is to one side or the other side in the transverse direction, and when moving the printhead in the transverse direction, moves the printhead in the opposite direction as the direction the carriage was moving when the paper jam of the recording paper was detected to the retracted position at the one side or the other side of the paper conveyance path in the transverse direction.

Thus comprised, the recording paper that jammed at the print position can be prevented from being further compressed and made difficult to remove by movement of the printhead.

Effect of the Invention

The invention moves the printhead away from the recording paper before moving the printhead in the transverse direction. The paper feed roller keeps the recording paper nipped and prevents the recording paper from lifting away from the paper conveyance path toward the printhead until the printhead reaches the retracted position. Therefore, contact between the printhead and the recording paper can be prevented or suppressed. Moving the recording paper on the paper conveyance path in the transverse direction when the printhead moves to the retracted position can also be prevented or suppressed. Removing the recording paper from the paper conveyance path being difficult when the recording paper is then released by the paper feed roller pair can therefore also be prevented or suppressed.

Other objects and attainments together with a fuller understanding of the invention will become apparent and appreciated by referring to the following description and claims taken in conjunction with the accompanying drawings.

DESCRIPTION OF EMBODIMENTS

A serial printer according to the present invention is described below with reference to the accompanying figures.

Figure 1:
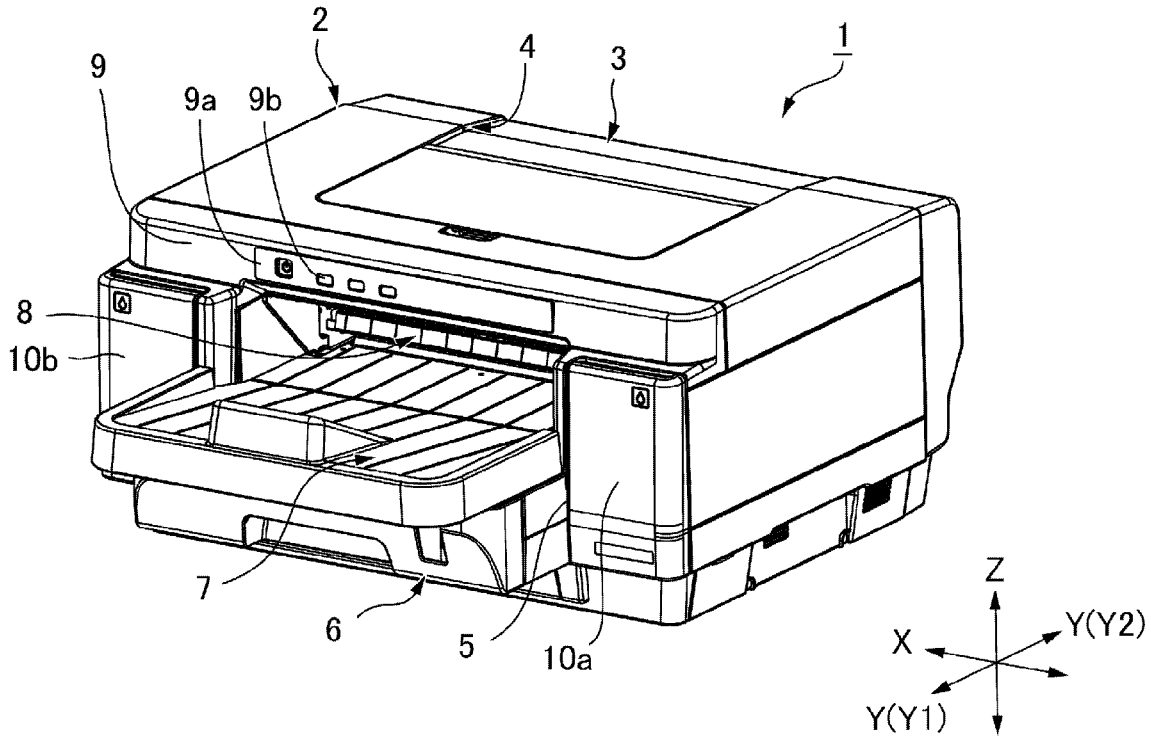
FIG. 1 is an oblique view of a serial printer according to the invention.

FIG. 1 is an external oblique view from the front of a serial printer according to the first embodiment of the invention. The serial printer 1 has a printer cabinet 2 and an inverting unit 3. The printer cabinet 2 is a basically rectangular box-like shape that is long on the transverse axis X widthwise to the printer. The inverting unit 3 is installed in a recess 4 formed in the middle of the back of the printer cabinet 2. The inverting unit 3 is a unit for inverting the front and back sides of the printing paper and then returning the inverted paper into the printer cabinet 2.

A paper cassette loading unit 5 is disposed to the printer cabinet 2. The paper cassette loading unit 5 opens to the front Y1 (the front on the longitudinal printer axis Y) at a position toward the bottom on the vertical printer axis Z at the front of the printer cabinet 2. A paper cassette 6 can be loaded from the front Y1 into the paper cassette loading unit 5. Printing paper (recording paper) P is stored in a stack in the paper cassette 6.

A paper discharge tray 7 is attached above the paper cassette loading unit 5. The front end of the paper discharge tray 7 protrudes to the front Y1 from the printer cabinet 2.

A rectangular paper exit 8 extending toward the back Y2 (the back on the longitudinal axis Y) is formed above the paper discharge tray 7.

Note that the transverse axis X, longitudinal axis Y, and vertical axis Z are all perpendicular to each other.

An operating panel 9*a* is disposed to the front case member 9 of the printer cabinet 2 above the paper exit 8. The operating panel 9*s* includes a power switch and other operating switches 9*b*. Rectangular access doors 10*a*, 10*b* are attached to the front case member 9 on opposite sides of the paper discharge tray 7 and paper exit 8. When the access doors 10*a*, 10*b* are open, the ink cartridge loading unit 10 (see FIG. 3) opens and the ink cartridges (not shown in the figure) can be replaced.

Internal Configuration

Figure 2:
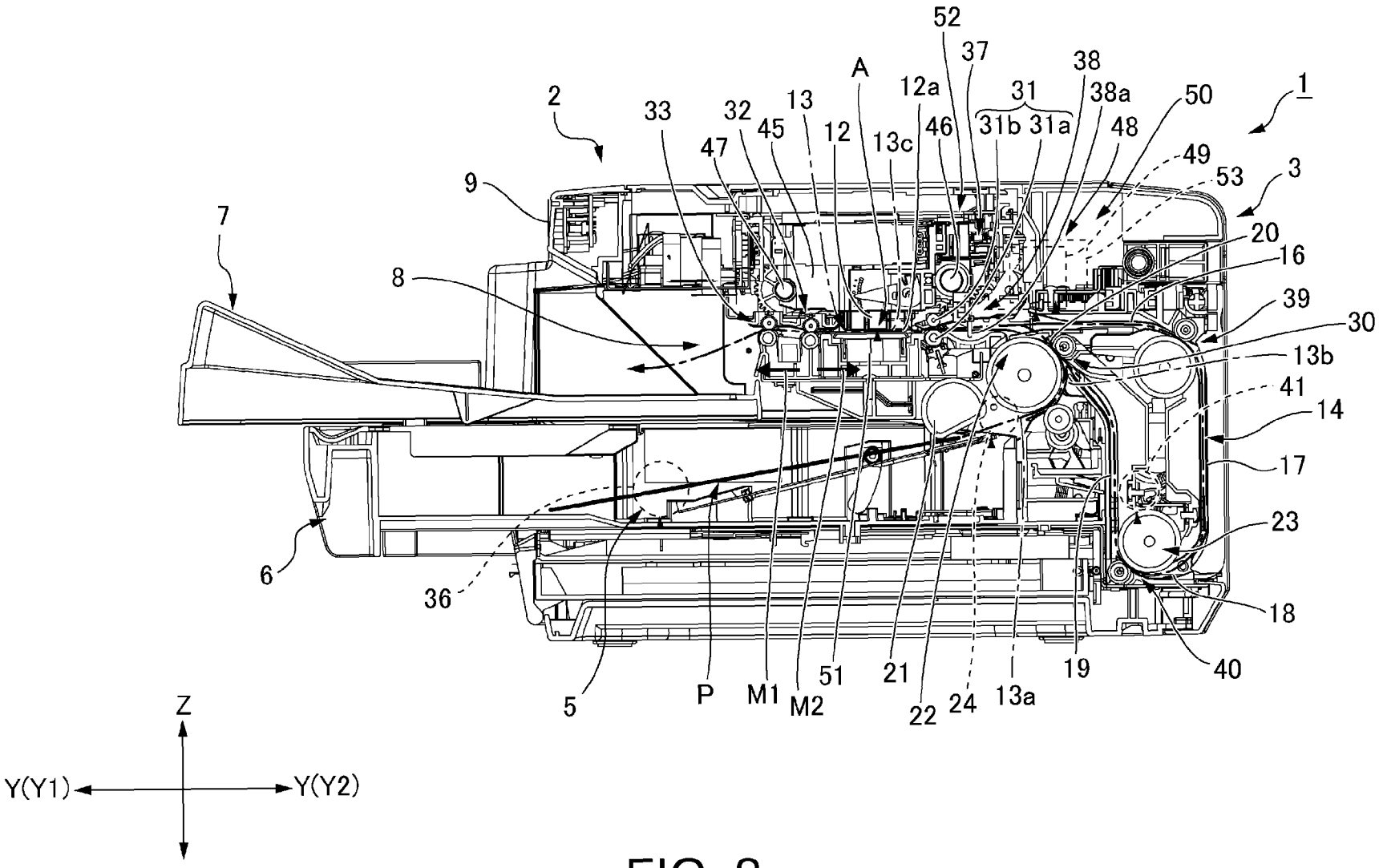
FIG. 2 is a vertical section view of the internal configuration of the serial printer in FIG. 1.

FIG. 2 is a vertical section view showing the internal configuration of the serial printer 1. A paper conveyance path 13 going from the paper cassette 6 past the print position A of the paper supply path 12 to the paper exit 8, and an inverting conveyance path 14 for reversing the front and back sides of the printing paper P, are formed inside the serial printer 1. The paper conveyance path 13 is formed inside the printer cabinet 2, and the inverting conveyance path 14 is formed inside the inverting unit 3.

The paper conveyance path 13 includes a sloped conveyance path portion 13*a* rising diagonally toward the printer back Y2 from the back end of the paper cassette 6, a curved conveyance path portion 13*b* that curves continuously from the back end of the sloped conveyance path portion 13*a* up and around toward the printer front Y1, and a horizontal conveyance path portion 13*c* extending substantially horizontally from the top front end of the curved conveyance path portion 13*b* toward the printer front Y1. The horizontal conveyance path portion 13*c* passes the print position A of the 12 and continues to the paper exit 8.

The inverting conveyance path 14 is a loop that connects to the middle of the paper conveyance path 13. The inverting conveyance path 14 includes an upstream conveyance path portion 16 that connects to the back end of the horizontal conveyance path portion 13*c* and extends to the printer back Y2; a descending conveyance path portion 17 that curves and extends down in a straight line from the upstream conveyance path portion 16; a bottom conveyance path portion 18 that connects to the descending conveyance path portion 17 and curves to the printer front Y1; and an ascending conveyance path portion 19 that curves and extends upward from the bottom conveyance path portion 18. The top part of the ascending conveyance path portion 19 curves at an angle toward the printer front Y1, and merges with the curved conveyance path portion 13*b*. Part of the ascending conveyance path portion 19 and the curved conveyance path portion 13*b* at the downstream side of the paper conveyance path 13 are a common path 20.

Inside the serial printer 1 are a paper feed roller 21 that supplies printing paper P stored in the paper cassette 6 to the paper conveyance path 13, a conveyance mechanism 22 that conveys the printing paper P through the paper conveyance path 13, and a inverting conveyance mechanism 23 that conveys the printing paper P through the inverting conveyance path 14.

The paper feed roller 21 is located above the back end part of the paper cassette 6 on the longitudinal axis Y. The paper feed roller 21 turns as driven by the paper feed motor 24, and feeds the printing paper P to the paper conveyance path 13.

The conveyance mechanism 22 includes a first paper feed roller pair 30, a second paper feed roller pair 31, a first discharge roller pair 32, and a second discharge roller pair 33 disposed along the paper conveyance path 13.

The first paper feed roller pair 30, second paper feed roller pair 31, first discharge roller pair 32, and second discharge roller pair 33 are disposed in order from the upstream side to the downstream side in the first conveyance direction M1 between the paper cassette 6 and the paper exit 8. The first paper feed roller pair 30 is disposed to the curved conveyance path portion 13*b*, and the second paper feed roller pair 31, the first discharge roller pair 32, and the second discharge roller pair 33 are disposed to the horizontal conveyance path portion 13*c*.

The drive source of the conveyance mechanism 22 is a conveyance motor 36 that is driven in forward or reverse. The conveyance motor 36 is a DC motor, and is disposed beside the paper cassette 6 on the transverse axis X.

The conveyance mechanism 22 conveys the printing paper P in the first conveyance direction M1 toward the paper exit 8 when the conveyance motor 36 is driven in the forward direction. When the conveyance motor 36 is driven in reverse, the conveyance mechanism 22 conveys the printing paper P in the second conveyance direction M2, which is the reverse of the first conveyance direction M1.

The second paper feed roller pair 31 is located on the back Y2 side of the print position A near the print position A. The second paper feed roller pair 31 includes a feed roller 31*a* to which drive power is transferred from the conveyance motor 36, and a follower roller 31*b* that follows the feed roller 31*a*. The feed roller 31*a* has a friction layer of dispersed inorganic particles on the surface of the roller. A roller moving mechanism 37 that moves the follower roller 31*b* between a nipping position 31A pressed against the feed roller 31*a* and a released position 31B separated from the feed roller 31*a* is disposed above the horizontal conveyance path portion 13*c*. The second paper feed roller pair 31 nips and conveys the printing paper P with the follower roller 31*b* at the nipping position 31A.

A paper detector 38 that detects the printing paper P at a detection position B located on the paper conveyance path 13 between the second paper feed roller pair 31 and the common path 20 is disposed above the back end part of the horizontal conveyance path portion 13*c*.

The paper detector 38 has a detection lever 38*a* that can contact the printing paper P passing the detection position B. The detection lever 38*a* is supported pivotably on a pivot axis extending on the transverse axis X, and is set to a preset middle position as shown in FIG. 2 when there is no printing paper P at the detection position B. When printing paper P is at the detection position B, contact by the printing paper P causes the detection lever 38*a* to pivot from the middle position to the paper-detected position, and the paper detector 38 thereby detects the printing paper P.

The inverting conveyance mechanism 23 conveys the printing paper P fed from the horizontal conveyance path portion 13*c* into the upstream conveyance path portion 16 by the conveyance mechanism 22 in one direction through the inverting conveyance path 14, and returns the printing paper P from the ascending conveyance path portion 19 to the horizontal conveyance path portion 13*c*. The inverting conveyance mechanism 23 includes a first inverting conveyance roller pair 39 disposed between the upstream conveyance path portion 16 and the descending conveyance path portion 17, and a second inverting conveyance roller pair 40 disposed between the bottom conveyance path portion 18 and the ascending conveyance path portion 19. The drive source of the inverting conveyance mechanism 23 is an inverting conveyance motor 41 separate from the conveyance motor 36, and is disposed in the inverting unit 3.

The printhead 12 is an inkjet head. The printhead 12 is mounted on the carriage 45 with the nozzle face 12*a* facing down. The carriage 45 is supported slidably on a carriage guide rail 46 and a carriage support rail 47 that extend substantially horizontally on the transverse axis X above the horizontal conveyance path portion 13*c*. A platen 51 is disposed below the printhead 12 with a specific gap therebetween. The platen 51 determines the print position A.

The carriage guide rail 46 and carriage support rail 47 are parallel to each other, and the carriage guide rail 46 is disposed behind the carriage support rail 47 on the printer back Y2 side. A carriage drive mechanism 48 that moves the carriage 45 bidirectionally on the transverse axis X along the carriage guide rail 46 and the carriage support rail 47 is disposed behind the carriage guide rail 46 on the printer back Y2 side. The drive source of the carriage drive mechanism 48 is a carriage motor (head moving motor) 49. The carriage guide rail 46, the carriage support rail 47, and the carriage drive mechanism 48 embody a carriage moving mechanism 50 (moving mechanism, first moving mechanism). The carriage 45 and the carriage moving mechanism 50 are disposed above the horizontal conveyance path portion 13*c*.

A carriage lift mechanism 52 (second moving mechanism) that moves the carriage 45 on the vertical axis Z is also disposed above the horizontal conveyance path portion 13*c*. The carriage lift mechanism 52 moves the carriage 45 and the printhead 12 up and down by moving the carriage guide rail 46 and the carriage support rail 47 up and down on the vertical axis Z. The carriage lift mechanism 52 moves the carriage 45 between a carriage-down position 45D (see FIG. 5) where the gap between the platen 51 and the printhead 12 is a first distance, and a carriage-up position 45U (FIG. 7B to FIG. 7D) where this gap is a second distance that is greater than the first distance. The printhead 12 therefore moves between a head reference position 12D where the gap between the platen 51 and the printhead 12 is a first distance, and a head-up position 12U where the gap between the platen 51 and the printhead 12 is the second distance.

The drive source of the carriage lift mechanism 52 is a lift motor 53. The lift motor 53 is disposed on the transverse axis X on the opposite side of the horizontal conveyance path portion 13*c* as the carriage motor 49. Note that except for when a printing paper P jam occurs, for example, the carriage 45 is normally at the carriage-down position 45D. The printhead 12 is therefore also normally at the head reference position 12D.

Figure 3:
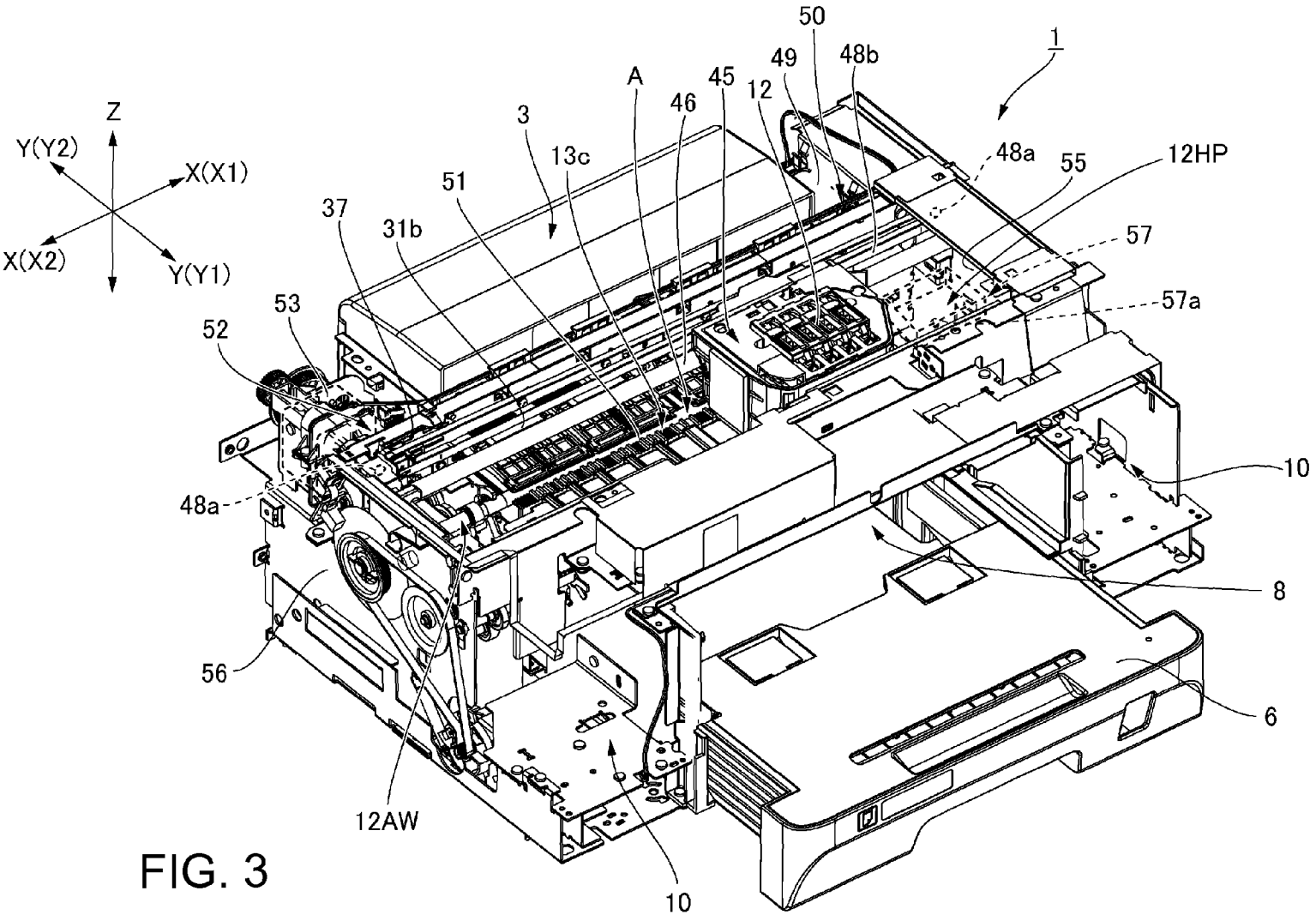
FIG. 3 is an oblique view of the serial printer from the front when the case is removed.
Figure 4:
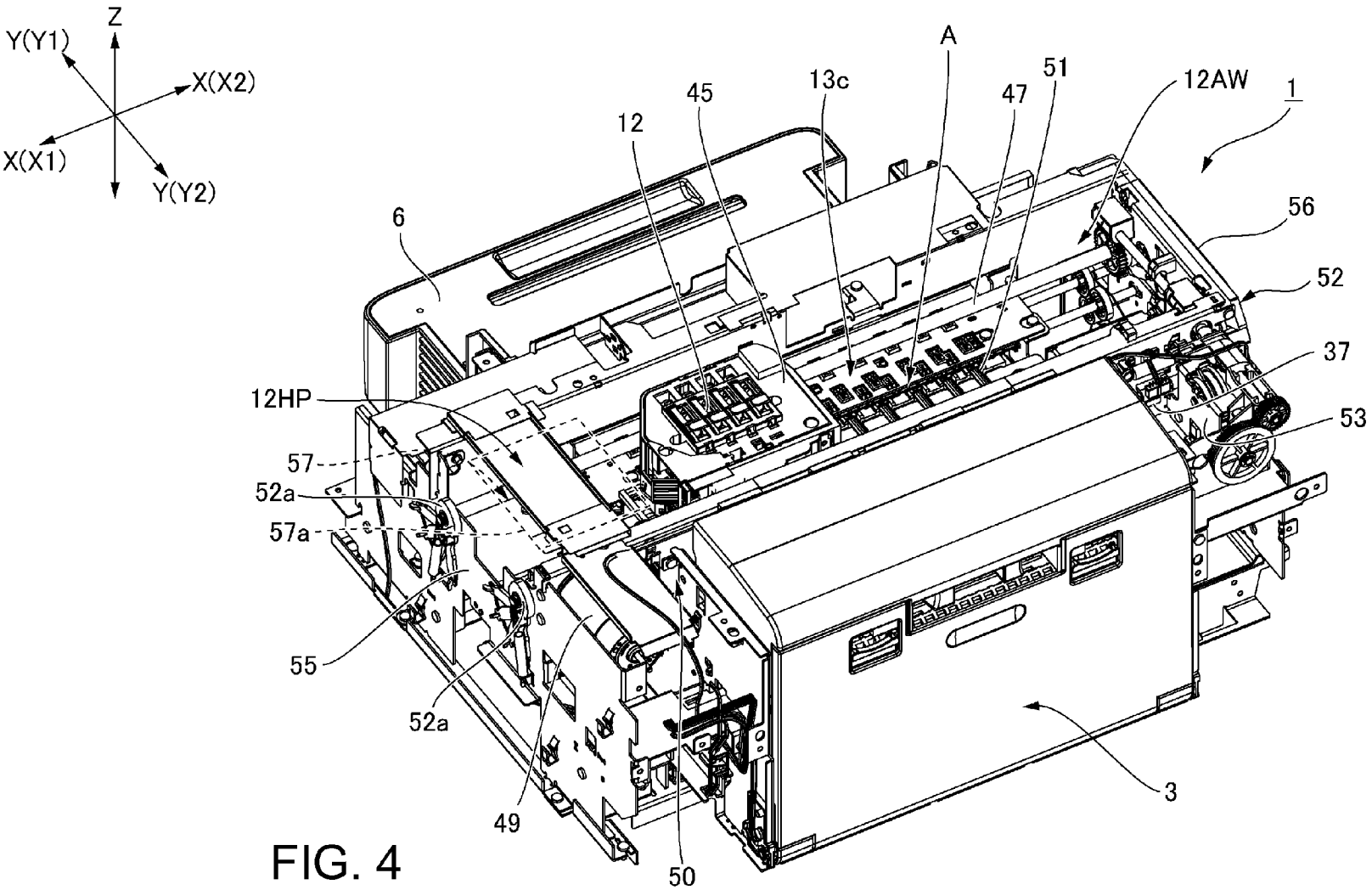
FIG. 4 is an oblique view of the serial printer from the back when the case is removed.
Figure 5:
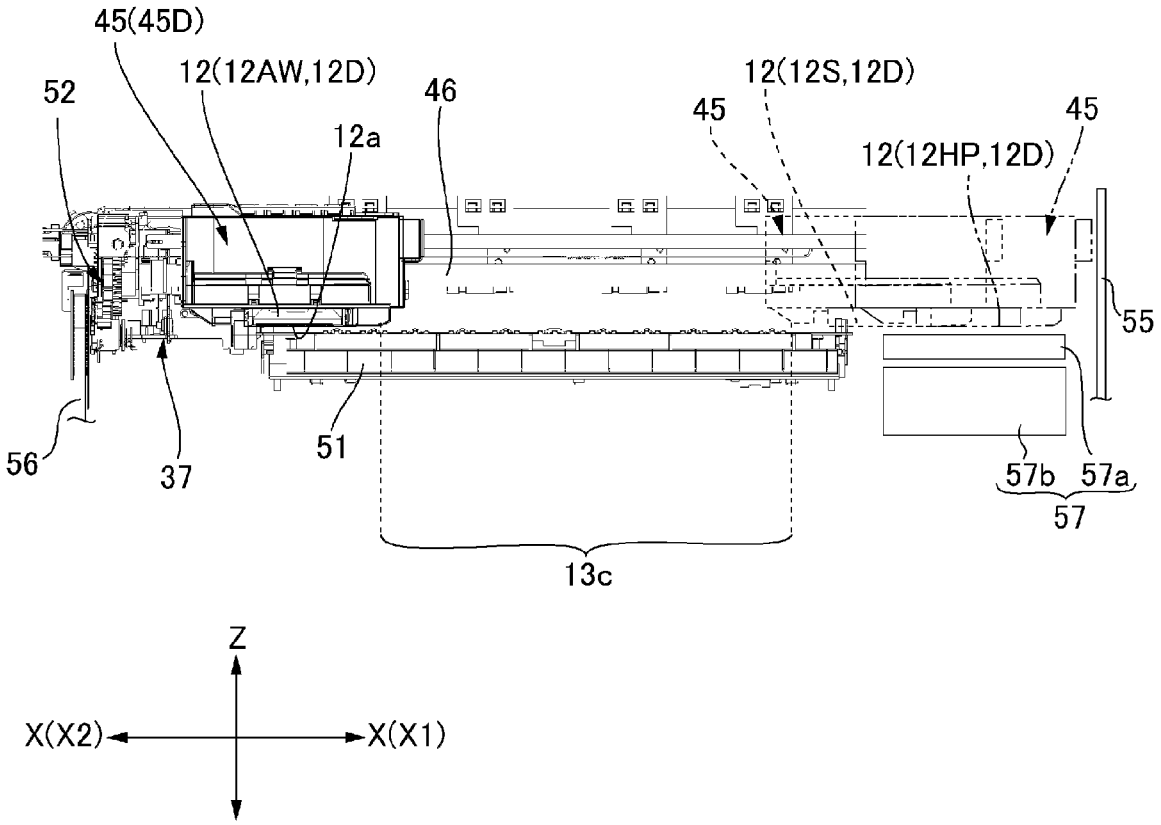
FIG. 5 illustrates the movement range of the printhead and the carriage.

The carriage moving mechanism 50 and the carriage lift mechanism 52 are described in further detail below with reference to FIG. 3, FIG. 4, and FIG. 5. FIG. 3 is an oblique view of the serial printer 1 from diagonally above the printer front Y1 without the front case member 9 and the paper discharge tray 7. FIG. 4 is an oblique view of the serial printer 1 from diagonally above the printer back Y2 without the front case member 9 and the paper discharge tray 7. FIG. 5 illustrates the movement range of the printhead 12 and the carriage 45, and shows the area around the carriage 45 from the front Y1.

As shown in FIG. 3 to FIG. 5, the carriage guide rail 46 and the carriage support rail 47 are supported at one end thereof by a first side frame 55, which extends up and on the longitudinal axis Y, at the ends on the first direction X1 of the transverse axis X.

The first side frame 55 is disposed with a specific gap to the horizontal conveyance path portion 13*c*.

The other ends of the carriage guide rail 46 and the carriage support rail 47 are supported by a second side frame 56, which is parallel to the first side frame 55, at the ends on the second direction X2 of the transverse axis X.

The second direction X2 is the opposite direction as the first direction X1.

The second side frame 56 is disposed with a specific gap to the horizontal conveyance path portion 13*c*.

The first side frame 55 and second side frame 56 support the carriage guide rail 46 and the carriage support rail 47 movably on the vertical axis Z. The first side frame 55 and second side frame 56 also support the carriage guide rail 46 and the carriage support rail 47 rotatably on their axes of rotation.

As shown in FIG. 3, the carriage drive mechanism 48 includes a pair of timing pulleys 48*a*, which are respectively disposed near the first side frame 55 and near the second side frame 56, and a timing belt 48*b* that is mounted on the pair of timing pulleys 48*a*. One part of the timing belt 48*b* is fastened to the carriage 45. By driving one of the timing pulleys 48*a* with the carriage motor 49, the carriage 45 moves along the carriage guide rail 46 and the carriage support rail 47.

As shown in FIG. 4, the carriage lift mechanism 52 includes eccentric cams 52*a*, cam support parts (not shown in the figure) that contact the outside cam surfaces of the eccentric cams 52*a*, and a power transfer mechanism 52*b*. The eccentric cams 52*a* are attached to one end of both the carriage guide rail 46 and the carriage support rail 47. The power transfer mechanism 52*b* transfers the drive power of the lift motor 53 to the carriage guide rail 46 and the carriage support rail 47 and causes the rails to rotate on their axes of rotation.

A cam support part is disposed to both the first side frame 55 and the second side frame 56. When the lift motor 53 is driven, the carriage guide rail 46 and the carriage support rail 47 turn synchronously. As a result, the eccentric cams 52*a* also turn, and rotation of the eccentric cam 52*a* causes the carriage guide rail 46 and the carriage support rail 47 to move up and down.

The lift motor 53 that is the drive source of the carriage lift mechanism 52 is also the drive source of the roller moving mechanism 37. More specifically, drive power from the lift motor 53 is transferred to the roller moving mechanism 37. In this example, after driving the lift motor 53 and moving the carriage 45 from the carriage-down position 45D to the carriage-up position 45U, the drive power of the lift motor 53 is then transferred to the roller moving mechanism 37 if driving the lift motor 53 continues. As a result, the follower roller 31*b* moves from the nipping position 31A to the released position 31B. If the lift motor 53 is driven in reverse when the follower roller 31*b* is set to the released position 31B, the follower roller 31*b* returns from the released position 31B to the nipping position 31A. The carriage lift mechanism 52 is then driven, and the carriage 45 moves from the carriage-up position 45U to the carriage-down position 45D. Note that except when a printing paper P jam occurs, for example, the follower roller 31*b* is normally at the nipping position 31A.

The home position 12HP of the printhead 12 is between the horizontal conveyance path portion 13*c* and the first side frame 55 as shown in FIG. 3 to FIG. 5. When the printhead 12 is at the home position 12HP, the carriage 45 is at a position removed to the outside in the first direction X1 from the horizontal conveyance path portion 13*c*.

The maintenance mechanism 57 of the printhead 12 is disposed to the home position 12HP. The maintenance mechanism 57 has a head cap 57*a* and a cap lift mechanism 57*b* (see FIG. 5).

The head cap 57*a* is disposed to a position opposite the nozzle face 12*a* of the printhead 12 when in the home position 12HP. The cap lift mechanism 57*b* moves the head cap 57*a* in the direction toward and the direction away from the printhead 12 of the printhead 12 at the home position 12HP. The printhead 12 is set to the home position 12HP at a regular predetermined time interval. When the printhead 12 is disposed to the home position 12HP the maintenance mechanism 57 performs a flushing operation that ejects ink droplets from the printhead 12 into the head cap 57*a*. This flushing operation is a maintenance operation performed to resolve nozzle clogging caused by increased ink viscosity, for example. When the serial printer 1 is in the standby mode, the carriage drive mechanism 48 moves the printhead 12 to the home position 12HP, resulting in the printhead 12 being covered by the head cap 57*a*.

The away position 12AW (retracted position) of the printhead 12 is between the horizontal conveyance path portion 13*c* and the second side frame 56. The away position 12AW is a space to which the printhead 12 moves outside of the horizontal conveyance path portion 13*c* when printing the end part of the second direction X2 of the printing paper P during the printing operation that prints to the printing paper P while the printhead 12 moves on the transverse axis X. When the printhead 12 is in the away position 12AW, the first direction X1 end of the carriage 45 is opposite the horizontal conveyance path portion 13*c*.

The printhead 12 moves in a line on the carriage guide rail 46 between the home position 12HP and the away position 12AW as a result of the carriage moving mechanism 50 moving the carriage 45 bidirectionally on the transverse axis X. As shown in FIG. 5, a standby position (retracted position) 12S of the printhead 12 is set between the horizontal conveyance path portion 13*c* and the home position 12HP. When the printhead 12 is set to the standby position 12S, the printhead 12 is located outside the horizontal conveyance path portion 13*c* on the first direction X1, but the second direction X2 end of the carriage 45 is opposite the horizontal conveyance path portion 13*c*.

Control System

Figure 6:
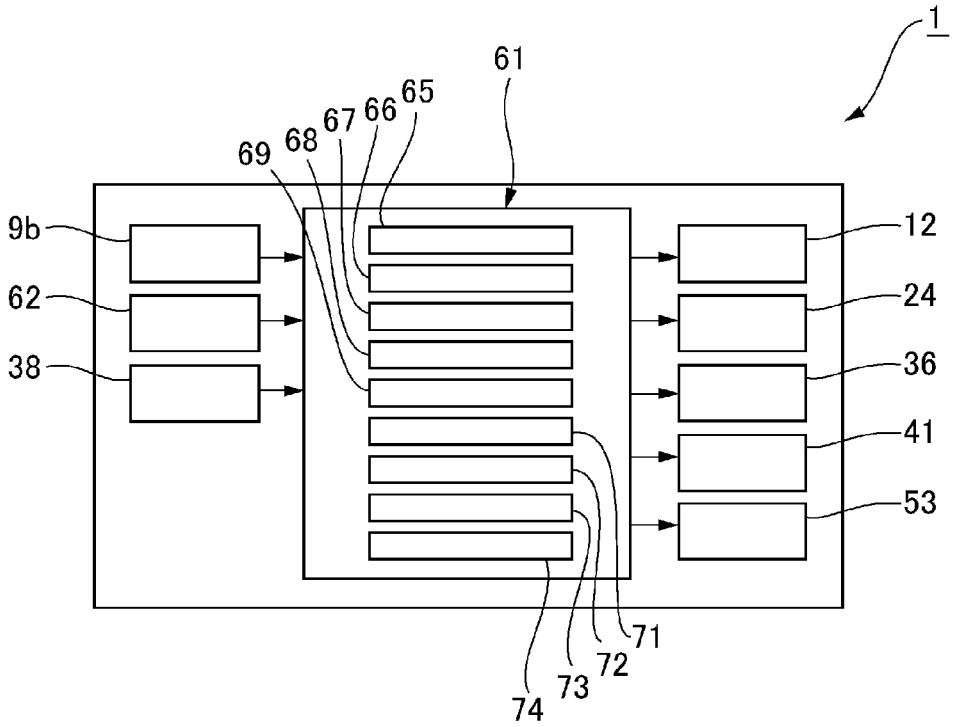
FIG. 6 is a block diagram illustrating the control system of the serial printer.

As shown in FIG. 6, the control system of the serial printer 1 is configured around a control unit 61 including a CPU. Connected to the input side of the control unit 61 are the operating switches 9*b*, a communication unit 62 that communicatively connects the serial printer 1 to a computer or other external device, and the paper detector 38. Connected to the output side of the control unit 61 are the printhead 12, the paper feed motor 24, the conveyance motor 36, the inverting conveyance motor 41, and the lift motor 53. The communication unit 62 sequentially inputs print data supplied from an external device to the control unit 61.

The control unit 61 includes a paper supply control unit 65, a position detection unit 66, a conveyance control unit 67, a print control unit 68, and a reversing control unit 69. The control unit 61 also has a first paper jam detector 71, a second paper jam detector 72, a first printhead retraction control unit 73 (first control unit), and a second printhead retraction control unit 74 (second control unit).

The paper supply control unit 65 drives the paper feed motor 24 to turn the paper feed roller 21, and feed printing paper P from the paper cassette 6 to the horizontal conveyance path portion 13*c*.

The position detection unit 66 calculates the cumulative conveyance distance of the printing paper P in the first conveyance direction M1 from when the paper detector 38 detects the printing paper P, and determines the position of the leading end of the printing paper P in the first conveyance direction M1 based on the cumulative conveyance distance and the length of the printing paper P in the first conveyance direction M1. The cumulative conveyance distance can be calculated based on how much the conveyance motor 36 is driven, such as how long drive power is applied to the conveyance motor 36. The length of the printing paper P can be acquired based on the paper size information contained in the print data, or the paper size information of the printing paper P set for the serial printer 1.

The conveyance control unit 67 drives the conveyance motor 36 forward to convey the printing paper P fed from the paper cassette 6 to the horizontal conveyance path portion 13*c* in the first conveyance direction M1 to the print position A.

More specifically, the conveyance control unit 67 conveys the printing paper P supplied from the paper cassette 6 past the detection position B, and after the printing paper P passes the detection position B, sets the intended start printing position on the first (front) side of the printing paper P to the print position A based on the position of the printing paper P obtained by the position detection unit 66. After the printing paper P returned from the inverting conveyance path 14 to the horizontal conveyance path portion 13*c* by the inverting conveyance mechanism 23 passes the detection position B, the conveyance control unit 67 conveys the printing paper P based on the position of the printing paper P acquired by the position detection unit 66, and positions the intended start printing position on the second (back) side of the printing paper P to the print position A.

The conveyance control unit 67 sets the printhead 12 to either the standby position 12S or the away position 12AW when conveying the printing paper P. More specifically, by setting the printhead 12 to the standby position 12S when conveying the printing paper P, the second direction X2 end part of the carriage 45 is over the horizontal conveyance path portion 13*c* as shown by the dotted line in FIG. 5. When the printhead 12 is set to the away position 12AW as shown by the solid line in FIG. 5, the first direction X1 end part of the carriage 45 is over the horizontal conveyance path portion 13*c*. As a result, the printing paper P conveyed through the horizontal conveyance path portion 13*c* is prevented by the bottom surface of the carriage 45 positioned over the horizontal conveyance path portion 13*c* from rising away from the platen when passing the print position A, and is conveyed through the horizontal conveyance path portion 13*c*.

The print control unit 68 prints on the printing paper P passing the print position A by alternately executing a printing operation in which the printhead 12 is driven to ejects ink droplets to the printing paper P at the print position A while driving the carriage motor 49 and moving the carriage 45 on the transverse axis X, and a paper feed operation that drives the conveyance motor 36 forward and advances the printing paper P a specific amount.

When printing on the front of the printing paper P ends, the print control unit 68 sets the printing paper P to a position closer to the paper exit 8 than the detection position B. When printing on the back of the printing paper P ends, the print control unit 68 drives the conveyance motor 36 forward and discharges the printing paper P from the paper exit 8.

When printing on the front of the printing paper P ends, the reversing control unit 69 drives the conveyance motor 36 in reverse, and feeds the printing paper P by means of the conveyance mechanism 22 from the horizontal conveyance path portion 13*c* to the inverting conveyance path 14. The reversing control unit 69 drives the inverting conveyance motor 41, conveys the printing paper P fed from the horizontal conveyance path portion 13*c* by the inverting conveyance mechanism 23 through the inverting conveyance path 14, and returns the printing paper P to the horizontal conveyance path portion 13*c*. When the printing paper P fed into the inverting conveyance path 14 by the conveyance mechanism 22 is detected by the paper detector 38, the reversing control unit 69 starts driving the inverting conveyance motor 41. When the printing paper P fed into the inverting conveyance path 14 by the conveyance mechanism 22 stops being detected by the paper detector 38, the reversing control unit 69 drives the conveyance motor 36 forward, enabling the printing paper P returned to the horizontal conveyance path portion 13*c* by the inverting conveyance mechanism 23 to be transferred to the conveyance mechanism 22. When the printing paper P transferred to the conveyance mechanism 22 is detected by the paper detector 38, conveyance control of the printing paper P moves from the reversing control unit 69 to the conveyance control unit 67.

The first paper jam detector 71 monitors the load on the carriage motor 49 while printing with the print control unit 68, and detects if the printing paper P jammed based on change in the load on the carriage motor 49. Therefore, the first paper jam detector 71 detects if the printing paper P has jammed when the printhead 12 is positioned over the horizontal conveyance path portion 13*c*. This embodiment of the invention detects current to determine the carriage motor 49 load, and when the detected current exceeds a predetermined threshold, determines that a paper jam has occurred. More specifically, when the paper jams, the printing paper P interferes with movement of the printhead 12 and the carriage 45, and the printhead 12 cannot move on the transverse axis X, the load on the carriage motor 49 increases, and the paper jam can be detected based on this change in the load on the carriage motor 49.

The second paper jam detector 72 monitors how much the conveyance motor 36 is driven and the motor load, and detects if the printing paper P has jammed based on the output of the paper detector 38 and the change in the driven amount and load of the conveyance motor 36. When the conveyance motor 36 is driven and the printing paper P is conveyed in the serial printer 1 according to this embodiment of the invention, the printhead 12 is set to the standby position 12S or the away position 12AW. Therefore, the second paper jam detector 72 detects if the printing paper P has jammed when the printhead 12 is at the standby position 12S or the away position 12AW. In other words, the second paper jam detector 72 detects jamming of the printing paper P when the printhead 12 is set to a position separated on the transverse axis X from the position opposite the horizontal conveyance path portion 13*c*. A paper jam in this event occurs if other printing paper P is left in the paper conveyance path 13 while the printing paper P is being conveyed, for example.

The second paper jam detector 72 detects the conveyance motor 36 current to detect the motor load, and detects a paper jam when the current exceeds a predetermined threshold. More specifically, when the printing paper P cannot be moved on the paper conveyance path 13 due to a paper jam, the load on the conveyance motor 36 increases. Therefore, the second paper jam detector 72 detects the paper jam based on change in the load of the conveyance motor 36. The paper jam is also detected in this embodiment of the invention based on how much the conveyance motor 36 is driven and the output of the paper detector 38. More specifically, the second paper jam detector 72 calculates the cumulative time that drive power is applied to the conveyance motor 36 as an indicator of how much the conveyance motor 36 is driven, and detects a paper jam if the printing paper P is not detected by the paper detector 38 even though this cumulative time exceeds the time required for the conveyance mechanism 22 to convey the printing paper P past the detection position B.

FIG. 7 illustrates the printhead 12 retraction operation of the first printhead retraction control unit 73. The first printhead retraction control unit 73 first stops the conveyance motor 36 when the first paper jam detector 71 detects that the printing paper P jammed.

Figure 7A:
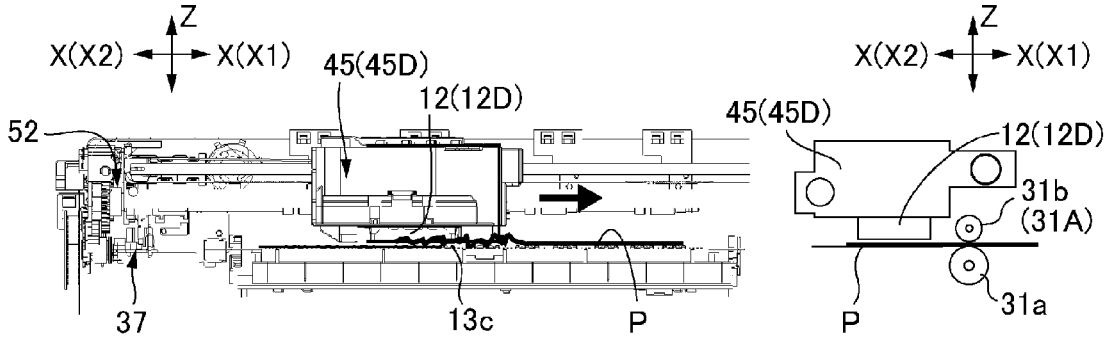
FIGS. 7A, 7B, 7C and 7D illustrate the retraction operation when the printhead is opposite the paper conveyance path.
Figure 7B:
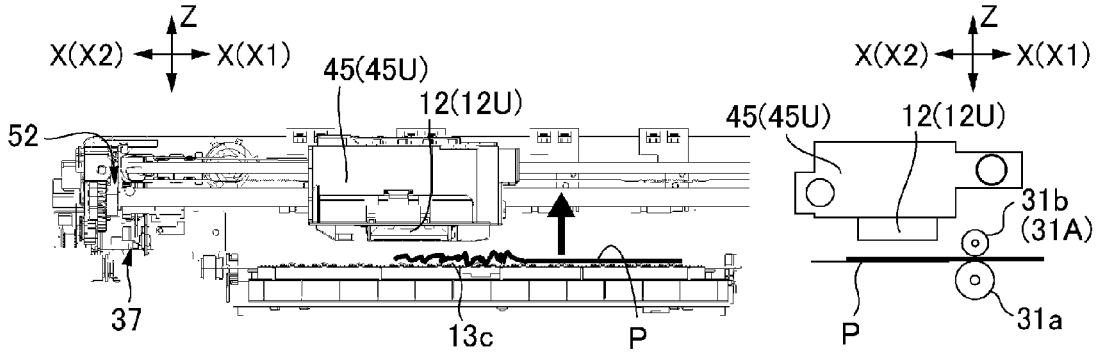
Figure 7C:
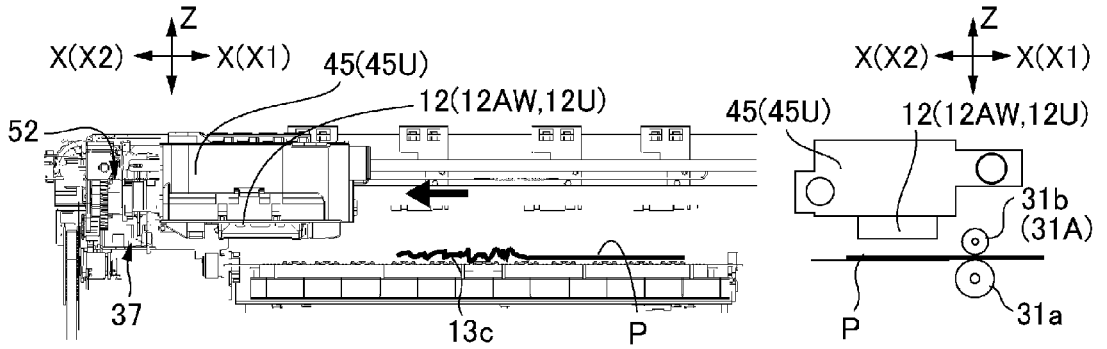
Figure 7D:
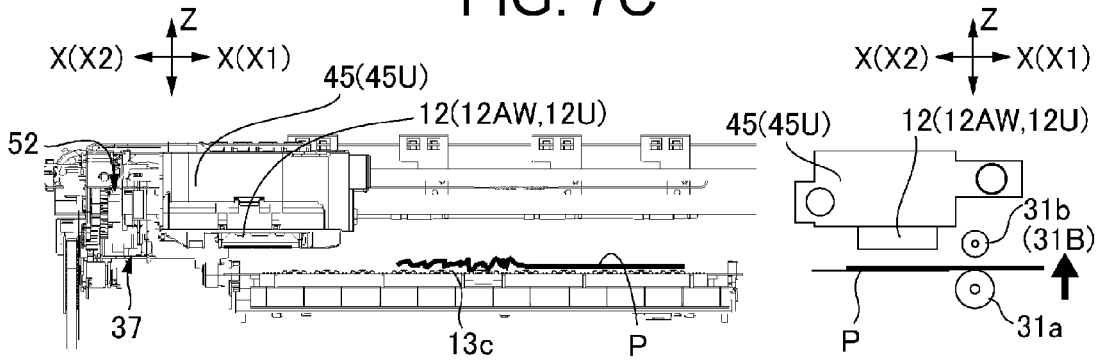

Next, the first printhead retraction control unit 73 drives the lift motor 53 and moves the printhead 12 in the direction away from the horizontal conveyance path portion 13*c* by means of the carriage lift mechanism 52. More specifically, the first printhead retraction control unit 73 moves the carriage 45 from the carriage-down position 45D shown in FIG. 7A to the carriage-up position 45U shown in FIG. 7B, and thereby moves the printhead 12 from the head reference position 12D to the head-up position 12U. Next, the first printhead retraction control unit 73 drives the carriage motor 49 to move the printhead 12 on the transverse axis X to the away position 12AW or the standby position 12S as shown in FIG. 7C. Next, the first printhead retraction control unit 73 drives the lift motor 53 again to move the follower roller 31*b* by means of the roller moving mechanism 37 from the nipping position 31A to the released position 31B as shown in FIG. 7D.

When the direction of carriage 45 movement (the direction of printhead 12 movement) by the carriage moving mechanism 50 is the first direction X1 or the second direction X2, and the printhead 12 moved to the head-up position 12U is moved on the transverse axis X, the first printhead retraction control unit 73 moves the carriage 45 in the opposite direction as the direction of carriage 45 movement immediately before a printing paper P jam was detected by the first paper jam detector 71. In other words, if the printing paper P is detected to be jammed while the carriage 45 is moving in the first direction X1 as shown in FIG. 7A, the first printhead retraction control unit 73 moves the carriage 45 to the carriage-up position 45U and sets the printhead 12 to the head-up position 12U, and then moves and sets the printhead 12 in the second direction X2 to the away position 12AW as shown in FIG. 7C. Note that if a printing paper P jam is detected while the carriage 45 is moving in the second direction X2, the carriage 45 is moved in the first direction X1 and set to the standby position 12S.

FIG. 8 illustrates the printhead 12 retraction operation of the second printhead retraction control unit 74. The second printhead retraction control unit 74 first stops the conveyance motor 36 when the second paper jam detector 72 detects a paper jam.

Figure 8A:
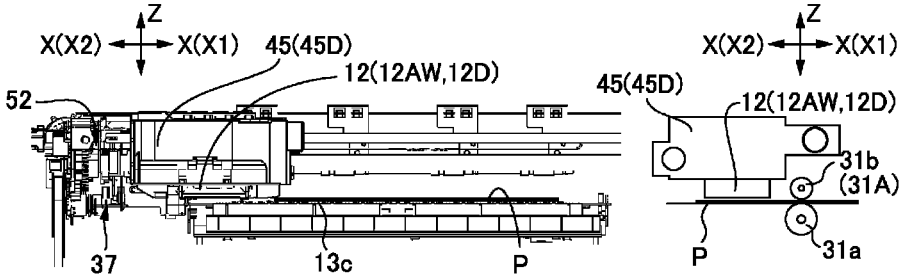
FIGS. 8A, 8B and 8C illustrate the retraction operation when the printhead is not opposite the paper conveyance path.
Figure 8B:
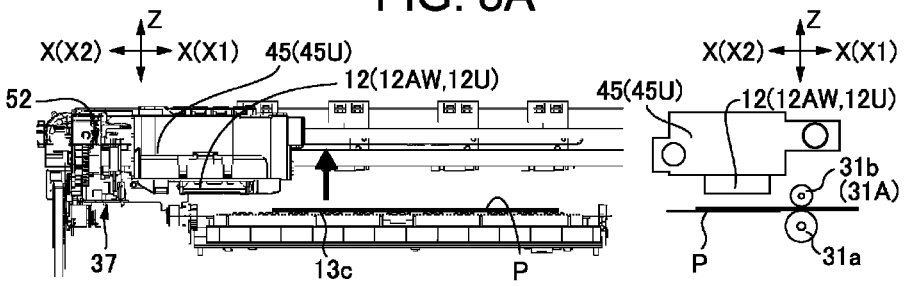
Figure 8C:
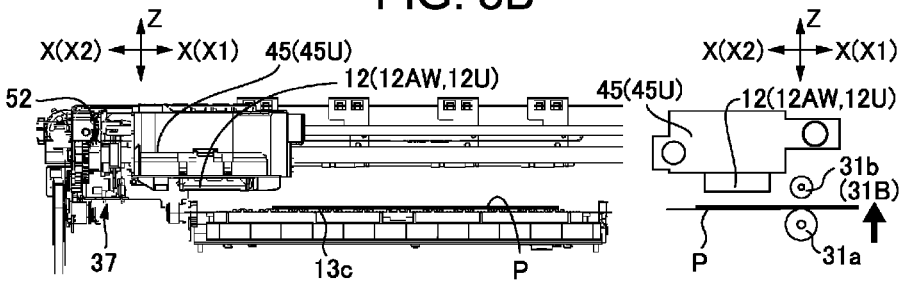

Next, the second printhead retraction control unit 74 drives the lift motor 53 and moves the printhead 12 in the direction away from the horizontal conveyance path portion 13*c* by means of the carriage lift mechanism 52. More specifically, when the first paper jam detector 71 detects that the printing paper P jammed, the first printhead retraction control unit 73 moves the carriage 45 from the carriage-down position 45D shown in FIG. 8A to the carriage-up position 45U shown in FIG. 8B, and thereby moves the printhead 12 from the head reference position 12D to the head-up position 12U. For example, as shown in FIG. 8, when the printhead 12 is at the away position 12AW, the printhead 12 is moved from the head reference position 12D to the head-up position 12U while at the away position 12AW. When the printhead 12 is at the standby position 12S, the printhead 12 is moved from the head reference position 12D to the head-up position 12U while at the standby position 12S. Next, the first printhead retraction control unit 73 drives the lift motor 53 to move the follower roller 31*b* by means of the roller moving mechanism 37 from the nipping position 31A to the released position 31B as shown in FIG. 8C.

Figure 9:
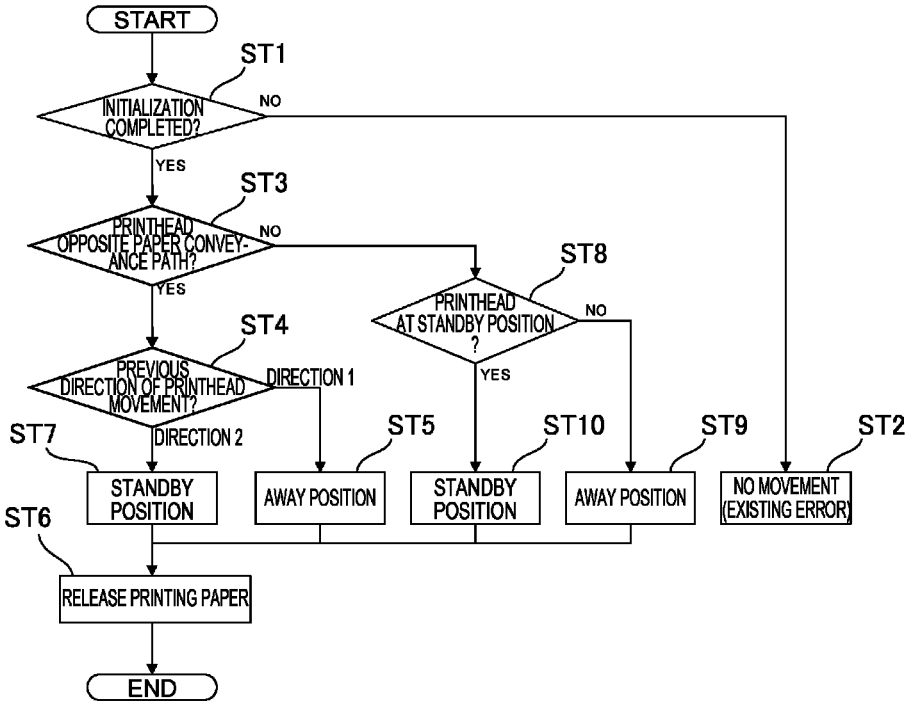
FIG. 9 is a flowchart of the method of determining the direction in which the printhead is retracted.

Retracting the Printhead During the Printing Operation and when a Paper Jam is Detected FIG. 9 is a flow chart illustrating the process of deciding the retraction direction of the printhead when a paper jam or other error occurs.

When the power turns on and the serial printer 1 is initialized, the carriage 45 is at the carriage-down position 45D and the printhead 12 is at the home position 12HP. The follower roller 31*b* is at the nipping position 31A. If an error has occurred in the printer before the initialization operation runs (step ST1 returns NO in FIG. 9), operation of the serial printer 1 stops without moving the printhead 12 in any direction (FIG. 9, step ST2). This is because the position of the printhead 12 cannot be determined before the initialization operation ends, and moving the printhead 12 could create an unexpected problem.

When the initialization operation ends (FIG. 9, step ST1 returns YES) and print data is supplied from an external device, the conveyance control unit 67 moves the printhead 12 from the home position 12HP to the standby position 12S. Next, the conveyance control unit 67 drives the paper feed motor 24 and supplies printing paper P stored in the paper cassette 6 to the horizontal conveyance path portion 13*c* by means of the paper feed roller 21. The conveyance control unit 67 also drives the conveyance motor 36 forward, and conveys the printing paper P fed into the horizontal conveyance path portion 13*c* in the first conveyance direction M1 by means of the conveyance mechanism 22. The conveyance control unit 67 then positions the intended start printing position on the front (first side) of the printing paper P to the print position A.

When the printing paper P is positioned to the print position A, the print control unit 68 drives the printhead 12, the carriage motor 49, and the conveyance motor 36 to run the printing process on the front of the printing paper P. The printing operation in which the printhead 12 ejects ink droplets toward the printing paper P while moving on the transverse axis X, and the paper feed operation of the conveyance mechanism 22, alternate during the printing process.

When the printing process ends, the reversing control unit 69 drives the conveyance motor 36 in reverse. The reversing control unit 69 also drives the inverting conveyance motor 41. As a result, the printing paper P is conveyed by the conveyance mechanism 22 in the second conveyance direction M2, and is fed from the horizontal conveyance path portion 13*c* to the inverting conveyance path 14. The printing paper P supplied to the inverting conveyance path 14 is conveyed through the inverting conveyance path 14 by the inverting conveyance mechanism 23, and is returned to the horizontal conveyance path portion 13*c* with the front and back sides reversed.

The reversing control unit 69 stops driving the conveyance motor 36 in reverse as soon as feeding the printing paper P into the inverting conveyance path 14 ends. The reversing control unit 69 then drives the conveyance motor 36 forward before the printing paper P is returned to the horizontal conveyance path portion 13*c*. As a result, the printing paper P returned to the horizontal conveyance path portion 13*c* is conveyed in the first conveyance direction M1 by the conveyance mechanism 22. Next, when the printing paper P passes the detection position B, the conveyance control unit 67 positions the intended start printing position on the back (second) side of the paper S to the print position A.

Next, the print control unit 68 drives the printhead 12, the carriage motor 49, and the conveyance motor 36, and applies the printing process to the back of the printing paper P. The printing operation in which the printhead 12 ejects ink droplets toward the printing paper P while moving on the transverse axis X, and the paper feed operation of the conveyance mechanism 22, alternate during the printing process. When the printing process is completed on the back side of the printing paper P, the print control unit 68 drives the conveyance motor 36 to discharge the printing paper P from the paper exit 8 by means of the conveyance mechanism 22.

If the printing paper P jams while the printhead 12 is moving on the transverse axis X during the printing process, for example, the first paper jam detector 71 detects that a paper jam occurred. This paper jam is a paper jam that occurred while the printhead 12 is positioned opposite the horizontal conveyance path portion 13*c* as shown in FIG. 7A (FIG. 9, step ST3 returns YES). In this event, the printhead 12 retraction operation is performed by the first printhead retraction control unit 73.

In the printhead 12 retraction operation, the first printhead retraction control unit 73 first stops the conveyance motor 36. As a result, conveyance of the printing paper P stops. Next, the first printhead retraction control unit 73 drives the lift motor 53, and moves the carriage 45 on the vertical axis Z in the direction away from the horizontal conveyance path portion 13*c*. More specifically, the carriage 45 is moved from the carriage-down position 45D shown in FIG. 7A to the carriage-up position 45U shown in FIG. 7B, and the printhead 12 moves from the head reference position 12D to the head-up position 12U. Next, the first printhead retraction control unit 73 drives the carriage motor 49 and moves the carriage 45 on the transverse axis X.

When the carriage 45 is moved on the transverse axis X, the first printhead retraction control unit 73 checks the direction of printhead 12 movement immediately before the printing paper P jam was detected (FIG. 9, step ST4), and then moves the printhead 12 in the opposite direction. In this example, the printhead 12 is moving in the first direction X1 immediately before the printing paper P jam is detected, and the carriage 45 is therefore moved in the second direction X2. As a result, the printhead 12 moves in the second direction X2 and is set to the away position 12AW as shown in FIG. 7C (FIG. 9, step ST5). Next, the first printhead retraction control unit 73 drives the lift motor 53, moves the follower roller 31*b* from the nipping position 31A to the released position 31B as shown in FIG. 7D, and releases the printing paper P from being nipped by the second paper feed roller pair 31 (FIG. 9, step ST6).

Note that if the printhead 12 was moving in the second direction X2 when the first printhead retraction control unit 73 checks the direction of printhead 12 movement (FIG. 9, step ST4), the carriage 45 is moved in the first direction X1 when the first printhead retraction control unit 73 drives the carriage motor 49 and moves the carriage 45 on the transverse axis X. As a result, the printhead 12 moves in the first direction X1 and is set to the standby position 12S (FIG. 9, step ST7). The first printhead retraction control unit 73 then releases the printing paper P from being nipped by the second paper feed roller pair 31 (FIG. 9, step ST6).

When a paper jam occurs while the printhead 12 is at a position opposing the horizontal conveyance path portion 13*c* in this example, conveyance of the printing paper P by the feed roller 31*a* stops first, the printhead 12 is then moved in the direction away from the horizontal conveyance path portion 13*c*, and the printhead 12 is separated from the jammed printing paper P. After then raising the printhead 12 to the head-up position 12U, the printhead 12 is moved on the transverse axis X. The printing paper P remains nipped by the second paper feed roller pair 31 until the printhead 12 reaches the away position 12AW on the transverse axis X, and the printing paper P is thereby prevented from rising from the horizontal conveyance path portion 13*c* to the printhead 12 side. Therefore, when the printhead 12 is at the away position 12AW separated from the horizontal conveyance path portion 13*c*, contact between the printing paper P and the printhead 12 is prevented or suppressed. Furthermore, because the printing paper P is nipped by the second paper feed roller pair 31 when the printhead 12 is moved on the transverse axis X, the printhead 12 is prevented or suppressed from moving the printing paper P on the horizontal conveyance path portion 13*c* in the transverse axis X in conjunction with the printhead 12 moving to the away position 12AW. Removing the printing paper P from the horizontal conveyance path portion 13*c* being difficult after the printing paper P is released by the second paper feed roller pair 31 can therefore also be prevented.

When the printhead 12 moves on the transverse axis X in this embodiment of the invention, the printhead 12 moves in the opposite direction as the direction the printhead 12 was moving immediately before the paper jam was detected. Therefore, the printing paper P that jammed at the print position A can be prevented from being further compressed and made difficult to remove by movement of the printhead 12 and carriage 45.

A paper jam can also result from other printing paper P being left in the paper conveyance path 13 when the printing paper P is conveyed. Such paper jams occur when the printhead 12 is at the standby position 12S or the away position 12AW, and are detected by the second paper jam detector 72. As shown in FIG. 8A, such paper jams are paper jams that occur when the printhead 12 is at the away position 12AW or the standby position 12S (FIG. 9, step ST3 returns NO).

The printhead 12 retraction operation of the second printhead retraction control unit 74 is performed in this event. In this example, as shown in FIG. 8A, a paper jam is detected by the second paper jam detector 72 when the printhead 12 is at the away position 12AW (FIG. 9, step ST8 returns NO).

In the printhead 12 retraction operation, the second printhead retraction control unit 74 first stops the conveyance motor 36. As a result, conveyance of the printing paper P stops. Next, the second printhead retraction control unit 74 drives the lift motor 53 and moves the carriage 45 on the vertical axis Z in the direction away from the horizontal conveyance path portion 13*c*. More specifically, as shown in paper exit 8 (*b*), the second printhead retraction control unit 74 moves the carriage 45 from the carriage-down position 45D to the carriage-up position 45U, and moves the printhead 12 from the head reference position 12D to the head-up position 12U at the away position 12AW (FIG. 9, step ST9). Next, the second printhead retraction control unit 74 drives the lift motor 53, moves the follower roller 31*b* from the nipping position 31A to the released position 31B, and thereby releases the printing paper P from being nipped by the second paper feed roller pair 31.

If the second paper jam detector 72 detects a paper jam when the printhead 12 is at the standby position 12S (FIG. 9, step ST8 returns YES), the second printhead retraction control unit 74 moves the carriage 45 from the carriage-down position 45D to the carriage-up position 45U, and moves the printhead 12 from the head reference position 12D to the head-up position 12U at the standby position 12S (FIG. 9, step ST10). Next, the second printhead retraction control unit 74 drives the lift motor 53 and releases the printing paper P from being nipped by the second paper feed roller pair 31 (FIG. 9, step ST6).

Because the printhead 12 is set to a position separated from the horizontal conveyance path portion 13*c* in this embodiment of the invention, contact between the printing paper P and the printhead 12 can be prevented or suppressed when the printing paper P is removed from the paper conveyance path 13 after being released from the second paper feed roller pair 31.

Other Embodiments

In this embodiment of the invention the carriage lift mechanism 52 moves the carriage 45 up and down by moving the carriage guide rail 46 and the carriage support rail 47 up and down on the vertical axis Z, but the carriage lift mechanism 52 may also be configured to move the carriage 45 up and down on the carriage guide rail 46 and thermal head carriage support rail 47.

Further alternatively, a configuration in which the printhead 12 is moved to the home position 12HP after the printhead 12 is moved to the standby position 12S by the first printhead retraction control unit 73 and the second printhead retraction control unit 74 is also conceivable. The nozzle face 12*a* of the printhead 12 set to the home position 12HP can be kept capped by the head cap 57*a* in this event until the jammed printing paper is removed.

The roller moving mechanism 37 moves the follower roller 31*b* in the embodiment described above, but a configuration in which the follower roller 31*b* is in a stationary position and the roller moving mechanism 37 moves the feed roller 31*a* is also conceivable. In this configuration, the feed roller 31*a* can be moved between a position where pressure is applied by the follower roller 31*b* and a position separated from the follower roller 31*b*, and the second paper feed roller pair 31 can therefore be changed between a state nipping the printing paper P and a state in which the printing paper P is not nipped.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A control method of a serial printer that conveys recording paper through a paper conveyance path past the print position of a printhead, and prints by moving the printhead at the print position transversely to the paper conveyance path and perpendicularly to the conveyance direction of the recording paper, comprising:

conveying the recording paper through the paper conveyance path by a conveyance mechanism including a paper feed roller pair disposed on the upstream side of the print position in the conveyance direction; and when a paper jam of the recording paper is detected when the printhead is positioned opposite the paper conveyance path, stopping conveyance of the recording paper, moving the printhead away from the paper conveyance path in the direction of opposition between the printhead and the paper conveyance path, then, after moving the printhead away from the paper conveyance path in the direction of opposition between the printhead and the paper conveyance path, moving the printhead in the transverse direction to a retracted position removed to the outside of the paper conveyance path, and then, after moving the printhead in the transverse direction to a retracted position removed to the outside of the paper conveyance path, releasing nipping of the recording paper by the paper feed roller pair.

2. The control method of a serial printer described in claim 1, further comprising:

when a paper jam of the recording paper is detected when the printhead is at the retracted position, stopping conveyance of the recording paper, moving the printhead away from the paper conveyance path in the direction of opposition, and then releasing nipping of the recording paper by the paper feed roller pair.

3. The control method of a serial printer described in claim 2, further comprising:

when a paper jam of the recording paper is detected when the printhead is at a position opposite the paper conveyance path, moving the printhead in the opposite direction as the direction the printhead was moving when the paper jam of the recording paper was detected, and setting the printhead to a retracted position at one side or the other side of the paper conveyance path width.

4. The control method of a serial printer described in claim 2, wherein:

a paper detector that detects the presence of the recording paper is disposed on the upstream side of the paper feed roller pair in the conveyance direction;

the control method further comprising monitoring the drive amount and the load of the conveyance motor that is the drive source of the conveyance mechanism; and detecting a paper jam of the recording paper when the printhead is at the retracted position based on the output of the paper detector and change in the drive amount and load of the conveyance motor.

5. The control method of a serial printer described in claim 1, further comprising:

monitoring the load of the head moving motor that is the drive source of the moving mechanism that moves the printhead in the transverse direction; and detecting a paper jam of the recording paper when the printhead is at a position opposite the paper conveyance path based on change in the load of the head moving motor.

6. A serial printer, comprising:

a printhead;

a carriage that carries the printhead;

a paper conveyance path that carries the recording paper past the print position of the printhead;

a conveyance mechanism that has a paper feed roller pair, which includes a paper feed roller and a follower roller, disposed upstream in the conveyance direction from the print position, and conveys the recording paper through the paper conveyance path;

a first moving mechanism that moves the carriage transversely to the paper conveyance path and perpendicularly to the conveyance direction;

a second moving mechanism that moves the carriage in the direction away from the paper conveyance path in the direction of opposition between the printhead and the paper conveyance path;

a roller moving mechanism that moves at least one of the paper feed roller and the follower roller of the paper feed roller pair from a nipping position where the paper feed roller pair can nip the recording paper to a release position where there is a gap to the other roller;

a conveyance motor that is the drive source of the conveyance mechanism;

a head moving motor that is the drive source of the first moving mechanism;

a conveyance control unit that drives the conveyance motor and conveys the recording paper;

a first paper jam detector that monitors the load of the head moving motor, and based on change in the load of the head moving motor, detects a paper jam of the recording paper when the printhead is at a position opposite the paper conveyance path; and a first control unit that, when a paper jam of the recording paper is detected by the first paper jam detector, stops the conveyance motor, drives the second moving mechanism and moves the printhead in the direction away from the paper conveyance path in the direction of opposition between the printhead and the paper conveyance path, then, after the driving of the second moving mechanism is complete, drives the head moving motor, moves the printhead in the transverse direction to a retracted position separated to the outside from the paper conveyance path, and then, after the driving of head moving motor is complete, drives the roller moving mechanism and moves at least one of the conveyance roller and the follower roller to the release position.

7. The serial printer described in claim 6, further comprising:

a paper detector that detects the presence of the recording paper on the upstream side of the paper feed roller pair in the conveyance direction;

a second paper jam detector that monitors the drive amount and the load of the conveyance motor, and detects a paper jam of the recording paper when the printhead is at the retracted position based on the output of the paper detector and change in the drive amount of the conveyance motor and the load of the conveyance motor; and a second control unit that, when a paper jam is detected by the second paper jam detector, stops the conveyance motor, drives the second moving mechanism and moves the printhead in the direction of opposition away from the paper conveyance path, and then drives the roller moving mechanism and moves at least one of the paper feed roller and the follower roller to the release position.

8. The serial printer described in claim 6, wherein:

the first control unit determines if the direction of carriage movement by the first moving mechanism is to one side or the other side in the transverse direction, and when moving the printhead in the transverse direction, moves the printhead in the opposite direction as the direction the carriage was moving when the paper jam of the recording paper was detected to the retracted position at the one side or the other side of the paper conveyance path in the transverse direction.

* * * * *